United States Patent [19]

Akers

[11] Patent Number: 4,774,733

[45] Date of Patent: Oct. 4, 1988

[54] RED FRAME

[76] Inventor: Brian L. Akers, R.R. 2, Orient, Iowa 50858

[21] Appl. No.: 445,907

[22] Filed: Dec. 1, 1982

[51] Int. Cl.[4] ..... A47C 31/02; B25G 3/00

[52] U.S. Cl. ..... 5/400; 403/332; 403/294; 5/451

[58] Field of Search ..... 5/400, 401, 411, 451, 5/201; 403/294, 332, 402, 283; 52/396, 403

[56] References Cited

U.S. PATENT DOCUMENTS

| | | | |
|---|---|---|---|
| 687,789 | 12/1901 | Rhynedance | 403/294 |
| 1,080,009 | 12/1913 | Housley | 403/332 |
| 3,732,585 | 5/1973 | Krehbiel | 5/400 |
| 3,937,585 | 2/1976 | Cattermole | 403/332 |
| 3,973,282 | 8/1976 | May | 5/451 |
| 4,109,887 | 8/1978 | Wakeland, Jr. | 5/451 |
| 4,128,907 | 12/1978 | Gelbart | 5/200 R |

FOREIGN PATENT DOCUMENTS

| | | | |
|---|---|---|---|
| 1554014 | 10/1969 | Fed. Rep. of Germany | 5/400 |

*Primary Examiner*—Gary L. Smith
*Assistant Examiner*—Vinh Luong
*Attorney, Agent, or Firm*—Zarley, McKee, Thomte, Voorhees & Sease

[57] ABSTRACT

A bed frame ideally suited for supporting a water mattress or the like comprises first and second frame members including vertically disposed and horizontally spaced pedestals having a pan portion at the upper end thereof. The first and second frame members are secured together to form the frame and are preferably comprised of a molded plastic material. Upstanding side walls are provided at the periphery of the pan portion to form an enclosure for the foam cushions, bolsters or mattress. The mating surfaces of the first and second frame members are provided with a seal so that the frame defines a water-tight enclosure for the water mattress or the like.

6 Claims, 3 Drawing Sheets

RED FRAME

BACKGROUND OF THE INVENTION

This invention relates to a bed frame and more particularly to a bed frame which is ideally suited for use with a water mattress or bed.

Conventional water bed frames are normally comprised of a great number of parts which add to the expense thereof and which make the frames difficult to assemble and disassemble. Additionally, the conventional water bed frames do not have any under-bed storage. Further, the conventional water bed frames do not provide a water-tight enclosure for the water bed so that a puncture in the water bed results in considerable water damage.

Therefore, it is a principal object of the invention to provide a simplified bed frame for a water mattress or the like.

Still another object of the invention is to provide a bed frame for a water mattress or the like which is comprised of a pair of identical frame members which are secured together.

Still another object of the invention is to provide a bed frame for a water mattress or the like comprised of a pair of identical frame members which may be nested within one another during shipment.

Still another object of the invention is to provide a bed frame for a water mattress or the like which is constructed of molded plastic material.

Still another object of the invention is to provide a bed frame which substantially reduces the number of parts normally employed in a bed frame.

Still another object of the invention is to provide a bed frame which is easily assembled and disassembled.

Yet another object of the invention is to provide a bed frame for a water mattress or the like which is extremely strong and durable.

Yet another object of the invention is to provide a bed frame for a water mattress or the like which provides a water-tight enclosure for the water bed.

Still another object of the invention is to provide a bed frame which is refined in appearance.

SUMMARY OF THE INVENTION

Figure 1:
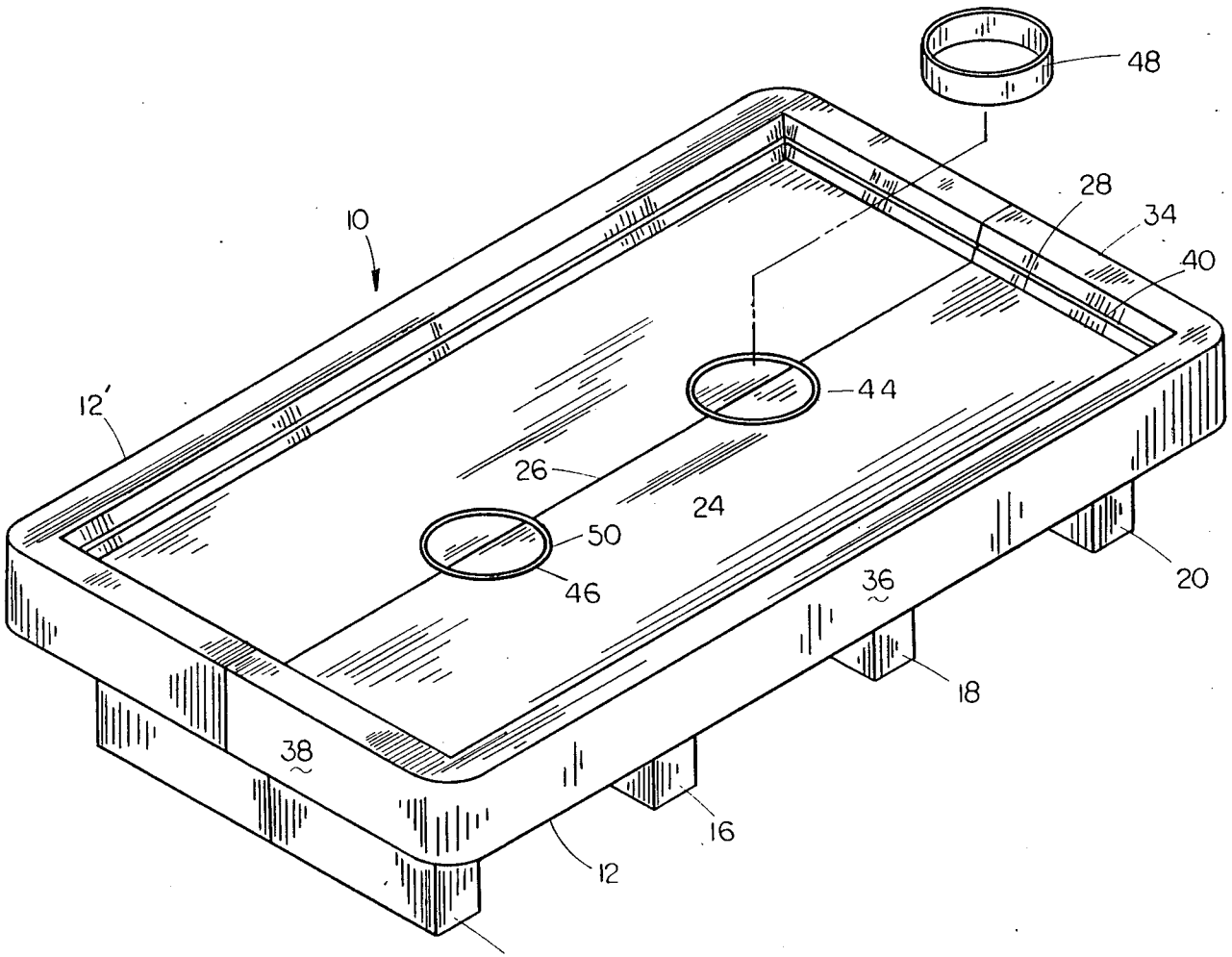
FIG. 1 is a perspective view of the assembled bed frame of this invention.
Figure 2:
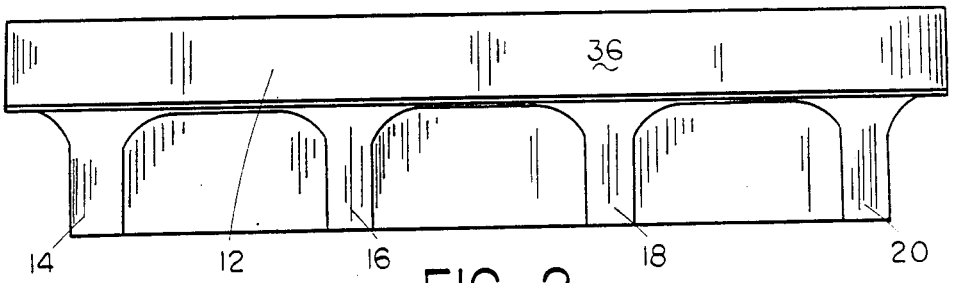
FIG. 2 is a side view of one of the frame members of this invention.
Figure 3:
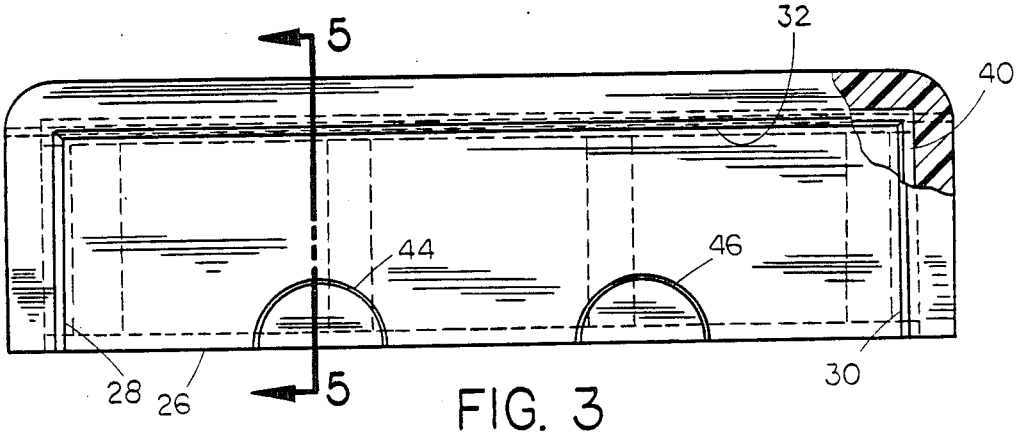
FIG. 3 is a top elevational view of the frame member of FIG. 2 with a portion thereof cut away to more fully illustrate the invention.
Figure 4:
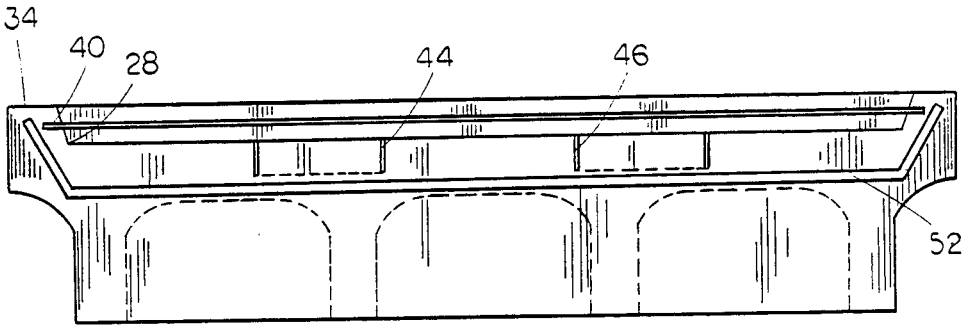
FIG. 4 is a side view of the frame member of FIGS. 2 and 3 as seen from the inner end thereof.

A bed frame is described comprised of identical first and second frame members preferably constructed of a molded plastic material. Each of the frame members comprises a plurality of vertically disposed and horizontally spaced pedestals having a pan portion provided at the upper end thereof. The inner ends of the frame members are secured together and the frame members have upstanding side walls extending therearound to provide an enclosure for the water mattress, cushions, bolsters, etc. A seal means is provided between the mating surfaces of the frame members so that a water-tight enclosure is provided for the water mattress to prevent water leakage from the frame should the mattress be punctured.

DESCRIPTION OF THE PREFERRED EMBODIMENT

The bed frame of this invention is referred to generally by the reference numeral 10 and is comprised of a pair of identical frame members 12 and 12'. Inasmuch as frame members 12 and 12' are identical, only frame member 12 will be described in detail.

Frame member 12 includes a plurality of vertically disposed and horizontally spaced pedestals 14, 16, 18 and 20. The upper ends of the pedestals 14, 16, 18 and 20 terminate in a pan portion 22 having a flat horizontally disposed supporting surface 24. For purposes of description, pan portion 22 will be described as having an inner edge portion 26, ends 28 and 30, and outer end 32. Upstanding side walls 34, 36 and 38 extend upwardly from supporting surface 24 of pan portion 22. The side walls just described are each provided with a groove 40 formed therein which extends inwardly into the tapered inner surface thereof. Grooves 40 are adapted to detachably receive the edge of a bolster, cushion or mattress.

Figure 5:
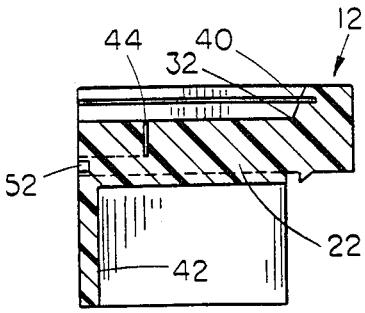
FIG. 5 is a sectional view taken on lines 5—5 of FIG. 3.
Figure 6:
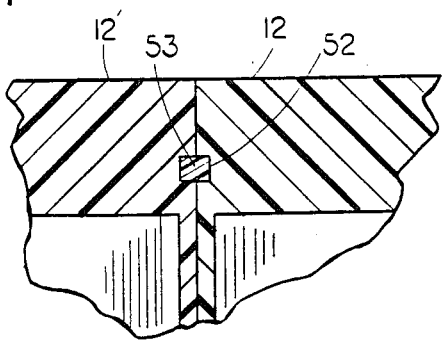
FIG. 6 is a sectional view illustrating the seal between the frame members.
Figure 7:
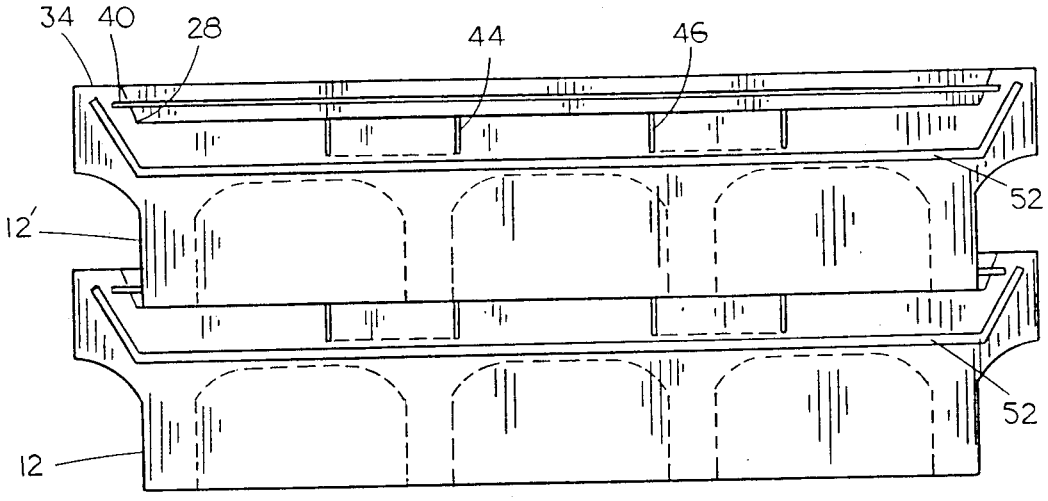
FIG. 7 is a side view of the frame members of the invention arranged in nested relation.

Bed frame 12 is also provided with leg or support portions 42 which extend between the inner ends of the pedestal as best illustrated in FIG. 5. A pair of semicircular grooves 44 and 46 are formed in supporting surface 24 of pan portion 22 and are adapted to register with the semi-circular grooves formed in frame member 12'. The frame members 12 and 12' are secured together by means of a pair of circular rings 48 and 50 which are received by the semicircular grooves. It should be noted that other means of securing the frame members 12 and 12' together may also be employed. The numeral 52 refers to a seal which is positioned in a suitable groove 53 formed in frame members 12 adn 12' between the mating surfaces of the frame members 12 and 12' so that a water-tight enclosure is provided for the water mattress.

Preferably, the frame members 12 and 12' are constructed of a suitable molded plastic material. It can be seen that a bed frame is provided wherein the bed frame may be comprised of a pair of identical frame members. The frame members are easily secured together with a minimum of skill. The bed frame of this invention may be easily assembled and disassembled and the frame members 12 and 12' may be nested together during shipment.

It can also be seen that the construction of the bed frame provides a rigid support for the water mattress or the like and that the space between the pedestals provides storage space not available in conventional water bed frames. Further, the height of the side walls may easily be varied to alter the design. Thus it can be seen that the invention accomplishes at least all of its stated objectives.

I claim:

1. A bed frame, comprising, first and second elongated frame members having transversely opposite sides and longitudinally opposite ends, each of said frame members comprising a plurality of vertically disposed pedestals having upper and lower ends, a horizontally disposed rectangular pan portion on the upper ends of said pedestals, said pan portion having a longitudinally extending inner edge, opposite ends, and an outer side, upstanding side wall portions extending upwardly from the ends and outer side of said pan, said pedestals comprising transversely extended and longitudinally spaced-apart wall members having inner and outer ends and defining open sided storage compartments below said pan portion, an upright support portion connected to and extending between inner ends of adjacent pedestals, said pedestals and support portion being positioned within the transverse and longitudinal extent of said pan portion whereby said first and second frame members may be arranged in nested relation for shipment, means securing the inner edges of said frame members together so that said frame members define a flat supporting surface having upstanding side walls extending therearound, and seal means positioned between said frame members to provide a watertight support pan for a water mattress.

2. The bed frame of claim 1 wherein each of said frame members has a pedestal closely adjacent each end thereof and at least one other pedestal positioned between said ends.

3. The bed frame of claim 1 wherein said side wall portions have aligned horizontally disposed grooves formed therein.

4. The bed frame of claim 1 wherein the pan portion of each of said frame members has at least one vertically disposed semi-circular groove formed therein at the inner edge thereof, said means securing said frame members comprising a circular ring received in said grooves.

5. The bed frame of claim 1 wherein each of said frame members is of one-piece construction.

6. The bed frame of claim 5 wherein each of said frame members is of molded construction.

* * * * *